US009486837B2

(12) United States Patent
Wardell et al.

(10) Patent No.: US 9,486,837 B2
(45) Date of Patent: Nov. 8, 2016

(54) WOVEN WIRE SCREENING AND A METHOD OF FORMING THE SAME

(71) Applicant: Lumsden Corporation, Lancaster, PA (US)

(72) Inventors: Myron Henry Wardell, Lititz, PA (US); Arthur Lumsden, Lancaster, PA (US); Jeffery L. Beck, Honey Brook, PA (US); Boyd E. Knepp, Lancaster, PA (US)

(73) Assignee: Lumsden Corporation, Lancaster, PA (US)

( * ) Notice: Subject to any disclaimer, the term of this patent is extended or adjusted under 35 U.S.C. 154(b) by 194 days.

(21) Appl. No.: 13/946,207

(22) Filed: Jul. 19, 2013

(65) Prior Publication Data

US 2015/0021240 A1 Jan. 22, 2015

(51) Int. Cl.

| | |
|---|---|
| ***B07B 1/49*** | (2006.01) |
| ***B07B 1/46*** | (2006.01) |
| ***B21F 27/18*** | (2006.01) |
| ***B21F 27/02*** | (2006.01) |

(52) U.S. Cl.

CPC ..... *B07B 1/4672* (2013.01); *B07B 1/4618* (2013.01); *B21F 27/02* (2013.01); *B21F 27/18* (2013.01)

(58) Field of Classification Search

CPC ..... B07B 1/12; B07B 1/46; B07B 1/4663; B07B 1/4672; B07B 1/48

USPC ..... 209/233, 392, 400–403

See application file for complete search history.

(56) References Cited

U.S. PATENT DOCUMENTS

| | | | | |
|---|---|---|---|---|
| 1,459,845 | A * | 6/1923 | Mitchell | 209/403 |
| 2,062,773 | A | 12/1936 | Weber | |
| 2,132,252 | A | 10/1938 | Weber | |
| 2,604,989 | A * | 7/1952 | Warhol | 209/401 |
| 2,723,032 | A * | 11/1955 | Jelks et al. | 209/401 |
| 3,716,138 | A * | 2/1973 | Lumsden | 209/401 |
| D238,776 | S | 2/1976 | Howells | |
| D239,827 | S | 5/1976 | Howells | |
| 4,024,612 | A * | 5/1977 | Contractor et al. | 28/105 |
| 4,120,785 | A | 10/1978 | Kanamori et al. | |
| 4,396,685 | A | 8/1983 | Jury | |
| 4,491,517 | A | 1/1985 | Janovac | |
| 4,923,583 | A | 5/1990 | Woodard et al. | |
| 5,716,718 | A | 2/1998 | Lai | |
| 6,510,947 | B1 * | 1/2003 | Schulte et al. | 210/388 |

(Continued)

OTHER PUBLICATIONS

Clean Thru, Buffalo Wire Works, Mar. 2005, 2 pages.

(Continued)

*Primary Examiner* — Joseph C Rodriguez
*Assistant Examiner* — Kalyanavenkateshware Kumar
(74) *Attorney, Agent, or Firm* — Merek, Blackmon & Voorhees, LLC

(57) ABSTRACT

A woven wire screening for use in classifying material flowing therethrough and a method of forming the same. The woven wire screening includes a plurality of warp wires and a plurality of weft wires. The plurality of warp wires and the plurality of weft wires are interwoven to form an integral wire cloth having a plurality of openings for permitting material to be classified to flow through the openings. The integral wire cloth includes an upper screening surface configured to enhance the tumbling action of product impacting the upper screening surface to improve throughput of the woven wire screening.

24 Claims, 18 Drawing Sheets

(56) References Cited

U.S. PATENT DOCUMENTS

| | | | | |
|---|---|---|---|---|
| 7,581,569 | B2 | 9/2009 | Beck | |
| 7,682,996 | B2 * | 3/2010 | Carr | 442/229 |
| 7,815,053 | B2 * | 10/2010 | Knepp | 209/400 |
| 7,980,392 | B2 * | 7/2011 | Larson et al. | 209/392 |
| 8,087,134 | B2 | 1/2012 | Morley | |
| 8,919,568 | B2 | 12/2014 | Beck et al. | |
| 2008/0148568 | A1 | 6/2008 | Morley | |
| 2009/0294334 | A1 * | 12/2009 | Knepp | 209/401 |
| 2011/0220555 | A1 | 9/2011 | Steadman | |
| 2014/0231316 | A1 | 8/2014 | Beck et al. | |
| 2016/0038977 | A1 | 2/2016 | Knepp et al. | |

OTHER PUBLICATIONS

Clean Slot, Buffalo Wire Works, at least as early as Jul. 18, 2012, 2 pages.

Office Action dated Dec. 31, 2015 issued in U.S. Appl. No. 14/192,117, filed Feb. 27, 2014, pp. 1 to 20.

Amendment dated Nov. 10, 2015 in U.S. Appl. No. 14/192,117, filed Feb. 27, 2014, pp. 1 to 9.

Hy Pro screen as described on pp. 10 and 11 of the remarks section of the Amendment filed with this IDS.

* cited by examiner

WOVEN WIRE SCREENING AND A METHOD OF FORMING THE SAME

FIELD OF THE INVENTION

The present invention is directed to woven wire screenings and a method of forming the same. More particularly, a preferred embodiment of the present invention is directed to woven wire screenings used in a shaker or vibrating screen apparatus that classifies material flowing through one or more woven wire screenings.

BACKGROUND OF THE INVENTION

One or more woven wire screens have been used in shaker or vibrating screen apparatus to size material passing through the woven wire screens. Known woven wire screens typically consist of a plurality of interwoven weft and warp wires forming a plurality of openings for permitting suitably sized material to pass through the screen. The openings can be square or rectangular. Alternatively, the screen can be formed as a long slot screen where the warp wires are maintained in spaced parallel relation by weft wires arranged in groups of three at spaced intervals along the length of the warp wires.

Conventional woven wire screens have limited efficiency due to the limited throughput of product through known woven wire screens for a given period of time. The preferred forms of the present invention are designed to significantly improve the throughput and thereby significantly improve the efficiency of woven wire screens.

OBJECTS AND SUMMARY OF THE INVENTION

An object of the present invention is to provide a novel and unobvious woven wire screening and a method of forming the same.

Another object of a preferred embodiment of the present invention is to provide a woven wire screening having an upper screening surface configured to improve the tumbling action of product impacting the upper screening surface to improve the throughput of the woven wire screening.

A further object of a preferred embodiment of the present invention is to provide a woven wire screening configured to obtain greater throughput than a conventional screen having the same open area.

Yet another object of a preferred embodiment of the present invention is to provide a woven wire screening with weft wires crimped to have a first crimp depth and warp wires crimped to have a second crimp depth creating a first knuckle height differential between the warp wires and weft wires and at least one additional wire configured to change the first knuckle height differential when the warp wires, the wefts wires and the at least one additional wire are interwoven to form the woven wire screening.

Still another object of a preferred embodiment of the present invention is to provide a woven wire screening that includes a plurality of weft wires and a plurality of warp wires where at least one of the warp and weft wires is configured such that the wire has at least one upper knuckle that is offset vertically from at least one other upper knuckle of the wire.

Yet still another object of a preferred embodiment of the present invention is to provide a woven wire screening having an upper screening surface configured to enhance tumbling action of product contacting the upper screening surface.

A further object of a preferred embodiment of the present invention is to provide a woven wire screening having an upper screening surface configured to enhance tumbling action of product contacting the upper screening surface where all wires of the woven wire screening are substantially identical.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to a woven wire screening for use in classifying material flowing through the woven wire screening. The woven wire screening includes a plurality of weft wires and a plurality of warp wires. The plurality of warp wires includes a plurality of first warp wires and at least one second warp wire. The plurality of warp wires and the plurality of weft wires being interwoven to form an integral wire cloth having a plurality of openings for permitting material to be classified to flow through the openings. Each of the plurality of first warp wires is crimped to form upper and lower knuckles. Each of the plurality of weft wires is crimped to form upper and lower knuckles. The plurality of weft wires have a first crimp depth and the plurality of first warp wires have a second crimp depth different from the first crimp depth such that the upper knuckles of the weft wires are offset vertically from the upper knuckles of the warp wires creating a knuckle height differential between the upper knuckles of the weft wires and the upper knuckles of the first warp wires. The at least one second warp wire is one of a straight wire and a crimped wire having a crimp depth different from the second crimp depth. The plurality of warps wires and the plurality of weft wires are arranged relative to each other such that substantially all of the openings of the integral wire cloth have substantially the same size.

Another preferred embodiment of the present invention is directed to a woven wire screening for use in classifying material flowing through the woven wire screening. The woven wire screening includes a plurality of warp wires and a plurality of weft wires. The plurality of warp wires and the plurality of weft wires are interwoven to form an integral wire cloth having a plurality of openings for permitting material to be classified to flow through the openings. The plurality of warp wires includes a plurality of crimped warp wires crimped to form upper and lower knuckles. The plurality of weft wires includes a plurality of crimped weft wires crimped to form upper and lower knuckles. The plurality of weft wires have a first crimp depth and the plurality of first warp wires have a second crimp depth different from the first crimp depth such that the upper knuckles of the weft wires are offset vertically from the upper knuckles of the warp wires creating a knuckle height differential between the upper knuckles of the weft wires and the upper knuckles of the first warp wires. The plurality of weft wires includes at least one of a straight weft wire and a crimped wire having a crimp depth different from the first crimp depth.

A further preferred embodiment of the present invention is directed to a method of forming a woven wire screening used in classifying material flowing through the woven wire screening. The method includes the steps of: (a) providing a plurality of crimped warp wires having upper and lower knuckles; (b) providing a plurality of crimped weft wires having upper and lower knuckles, the plurality of crimped weft wires are crimped differently than the plurality of crimped warp wires creating a first knuckle height differential between the upper knuckles of the crimped weft wires and the upper knuckles of the crimped warp wires; (c) providing at least one additional wire, the at least one additional wire is one of a straight wire and a crimped wire having a crimp depth different from the crimp depth of one of the following: (i) the plurality of crimped warp wires; and, (ii) the plurality of crimped weft wires; (d) interweaving the plurality of crimped warp wires, the plurality of crimped weft wires and the at least one additional wire such that the at least one additional wire changes the first knuckle height differential between an upper knuckle of at least one crimped warp wire and an upper knuckle of at least one crimped weft wire; and (e) forming an integral wire cloth such that substantially all openings in the integral wire cloth have substantially the same size.

Still another preferred embodiment of the present invention is directed to a woven wire screening for use in classifying material flowing through the woven wire screening. The woven wire screening includes a plurality of weft wires and a plurality of warp wires. Each of the plurality of warp wires is crimped to form upper and lower knuckles. Each of the plurality of weft wires is crimped to form upper and lower knuckles. The woven wire screening includes at least first and second straight wires. The first straight wire has a cross-sectional height greater than the second straight wire and extends substantially parallel to the second straight wire. The plurality of warp wires, the plurality of weft wires and the first and second straight wires are interwoven to form an integral wire cloth having a plurality of openings for permitting material to be classified to flow through the openings.

Still a further preferred embodiment of the present invention is directed to a woven wire screening for use in classifying material flowing through the woven wire screening. The woven wire screening includes a plurality of weft wires and a plurality of warp wires. The plurality of warp wires and the plurality of weft wires are interwoven to form an integral wire cloth having a plurality of openings for permitting material to be classified to flow through the openings. A first wire includes a first set of knuckles. The first wire is either a warp wire or a weft wire. The first set of knuckles is one of a plurality of upper knuckles and a plurality of lower knuckles. At least one of the first set of knuckles is offset vertically from at least one other of the first set of knuckles.

DETAILED DESCRIPTION OF THE PREFERRED EMBODIMENTS OF THE INVENTION

Figure 1:
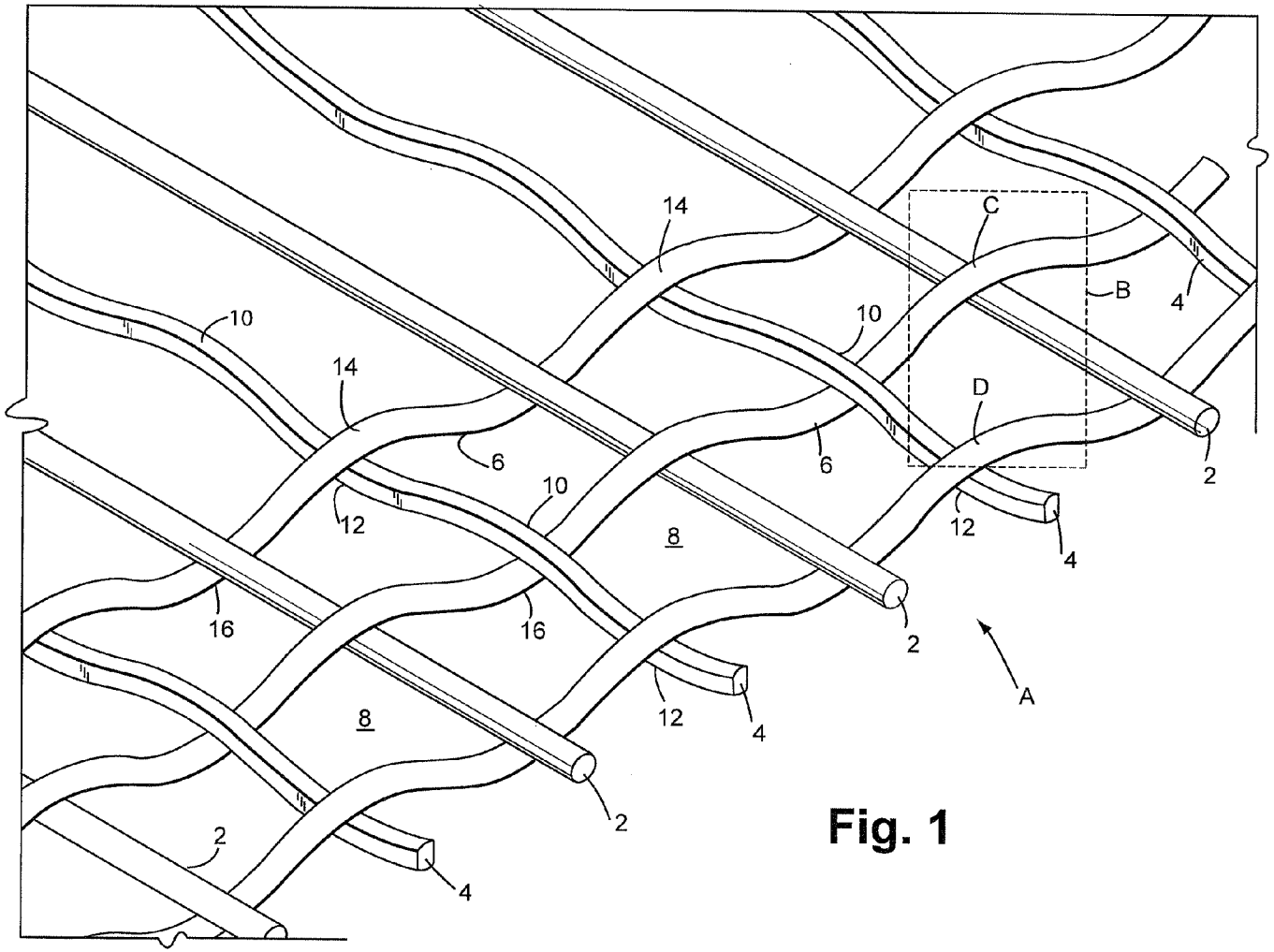
FIG. 1 is a perspective view of a portion of a woven wire screening formed in accordance with a preferred embodiment of the present invention.

The preferred forms of the invention will now be described with reference to FIGS. 1 through 18. The appended claims are not limited to the preferred forms and no term and/or phrase used herein is to be given a meaning other than its ordinary meaning unless it is expressly stated that the term and/or phrase shall have a special meaning.

FIGS. 1-6

Referring to FIGS. 1, 2 and 4 to 6, a woven wire screening or screen A formed in accordance with a preferred embodiment of the present invention is illustrated in one of many possible configurations. Screen A includes a first set of warp wires 2 and a second set of warp wires 4. Screen A further includes a plurality of weft wires 6. Weft wires 6 are also referred to as fill wires. Preferably, the weft wires 6 are uniformly spaced along the length of first and second sets of warp wires 4 and 6, respectively. It should be noted that some weft wires have been removed from the screen portion depicted in FIG. 1 for purposes of illustration only.

The first set of warp wires 2, the second set of warp wires 4 and the plurality of weft wires 6 are interwoven to form an integral wire cloth having a plurality of openings 8 through which appropriately sized product passes through during the process of classifying materials into various sizes or size ranges. In the most preferred embodiment, all of the openings 8 in woven wire screen A are of the same size and shape. Preferably, openings 8 are rectangular or square. It should be noted that the present invention is not limited to woven wire screens having openings of the same size and shape. For example, the screen can be formed as a long slot screen where the warp wires are maintained in spaced parallel relation by weft wires arranged in groups of three at spaced intervals along the length of the warp wires. The long slot screen has at least two different size openings.

The first set of warp wires 2 are straight wires, i.e., wires that are not crimped prior to interweaving the weft and warp wires to form the integral wire cloth. The warp wires 2 are shown as having a circular cross-section. However, warp wires 2 can be shaped in a similar manner as warp wires 4 to have two substantially flat sidewalls. Warp wires 4 are crimped prior to interweaving of the warp and weft wires to form upper knuckles 10 and lower knuckles 12 alternately spaced along the length of each of the warp wires 4. The distance between the upper knuckles 10 and the lower knuckles 12 of a given wire is referred to as the crimp depth.

Warp wires 4 are shown as being shaped wires, i.e., wires that have passed through shaping rollers to form two substantially flat sidewalls. However, warp wires 4 could have a circular cross-section. In the embodiment illustrated in FIG. 1, the odd warp wires are straight wires and the even warp wires are crimped wires. However, the odd warp wires could be crimped and the even warp wires straight. Further, the arrangement of the straight warp wires and crimped warp wires can be varied as desired. For example, the screen A could be configured such that you have two or more straight warp wires on each side of one or more crimped warp wires. Alternatively, screen A could be configured such that you have two or more crimped warp wires on each side of one or more straight warp wires.

Figure 2:
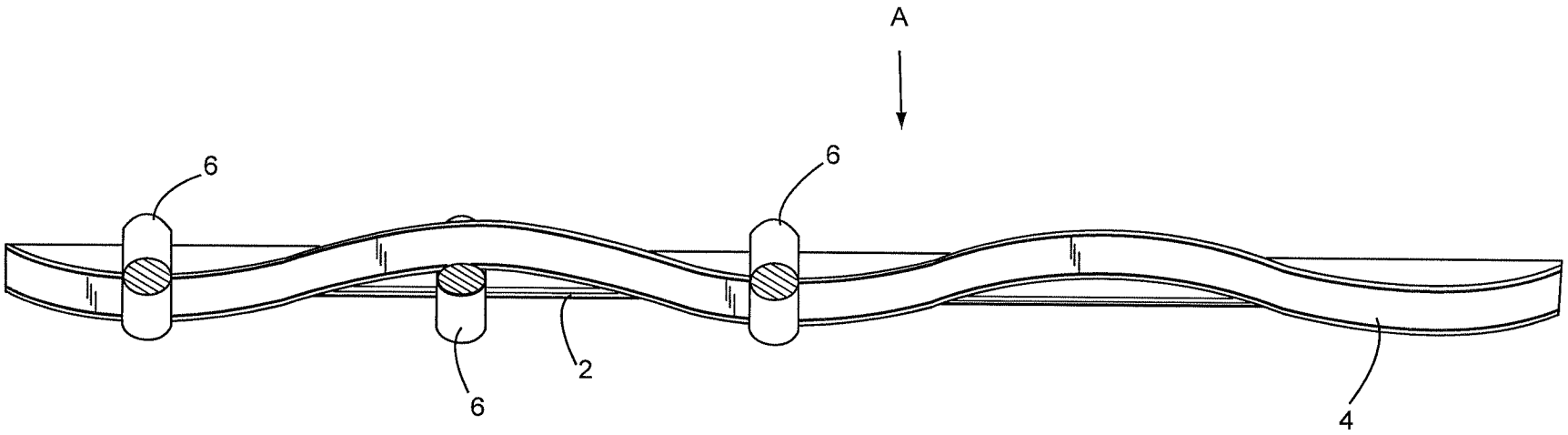
FIG. 2 is a cross-sectional view taken along the longitudinal axis (i.e., an axis extending parallel to the warp wires) of the preferred embodiment depicted in FIG. 1.
Figure 5:
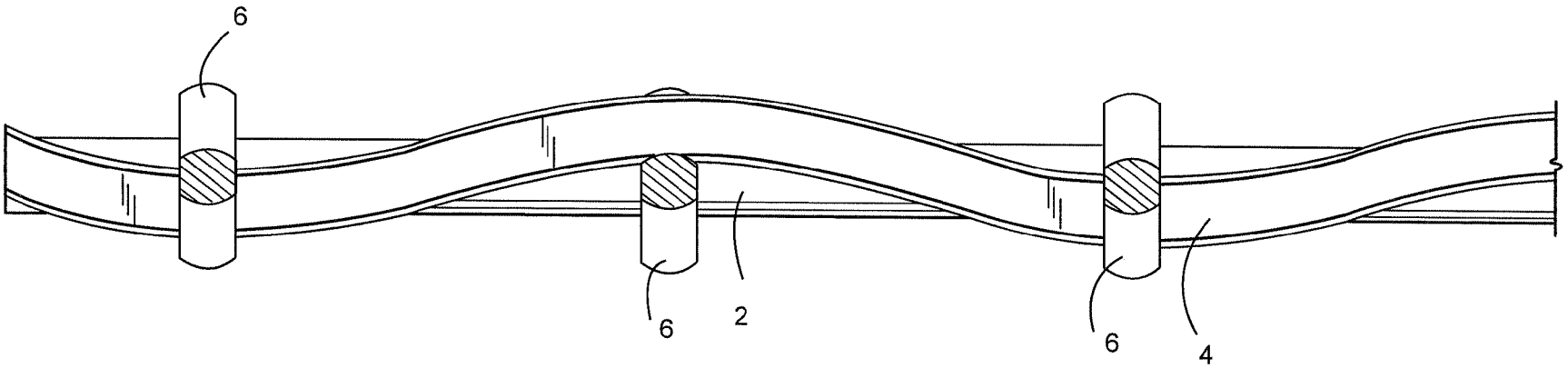
FIG. 5 is a cross-sectional view taken along the longitudinal axis (i.e., an axis extending parallel to the warp wires) of another variation of the woven wire screening depicted in FIG. 1 where the weft wires are shaped to have two substantially flat sidewalls as opposed to the round, circular cross-section of the weft wires in FIG. 1.
Figure 6:
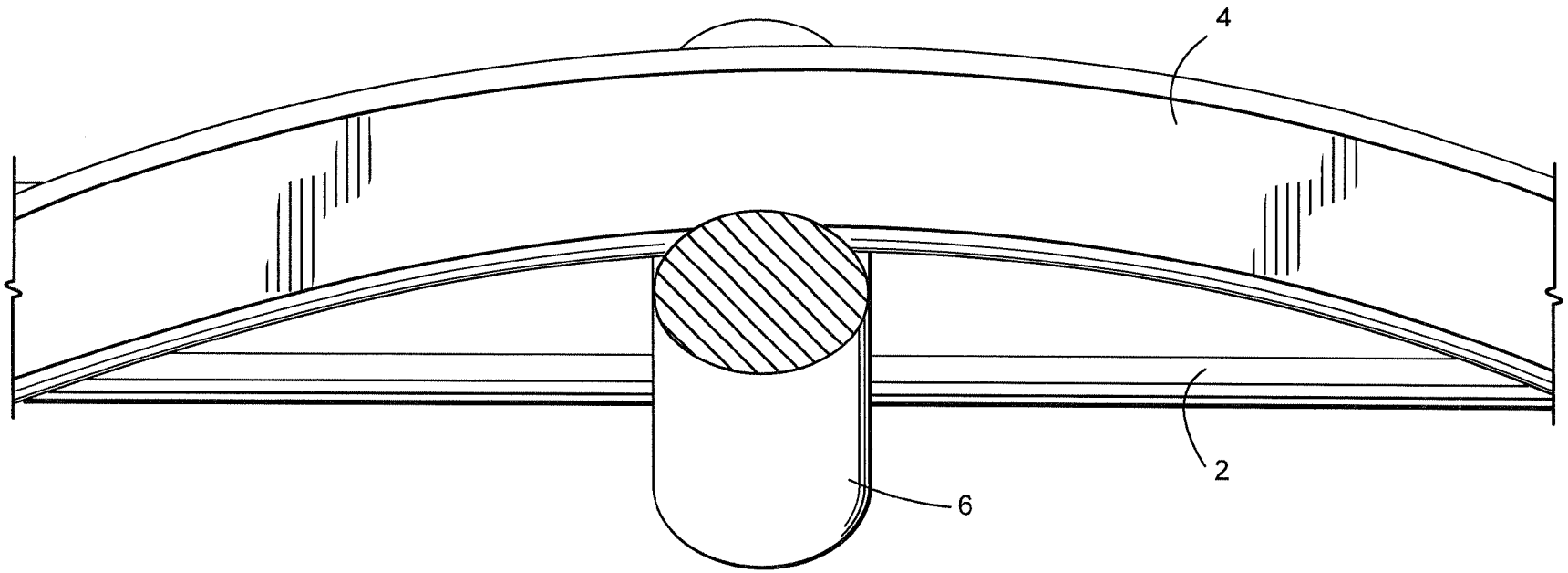
FIG. 6 is an enlarged cross-sectional view taken along the longitudinal axis (i.e., an axis extending parallel to the warp wires) of a portion of the preferred embodiment depicted in FIG. 1.

Each of the weft wires 6 are preferably crimped wires having upper knuckles 14 and lower knuckles 16. Referring to FIG. 2, weft wires 6 are shown as having a circular cross-section. However, weft wires 6 can be shaped similar to warp wires 4 to have two substantially flat sidewalls as shown in FIG. 5. It should be noted that regardless of the cross-sectional shape of the warp and weft wires each of the warp wires 2 and 4 and the weft wires 6 can originate from the same size wire. Preferably, the crimp depth of the weft wires 6 is greater than the crimp depth of warp wires 4. Screen A may be formed such that the ratio of the knuckle height differential between the upper knuckles of the weft wires 6 and the upper knuckles of warp wires 4 and a width of opening 8 ranges from 5% to 35% pursuant to the teachings of U.S. Pat. No. 7,815,053. It should be noted that the crimp depth of the weft wires 6 could be less than the crimp depth of the warp wires 4.

Referring to FIG. 1, the woven wire screen A achieves a knuckle height differential between upper knuckles of the weft wires 6 even though each of the weft wires 6 has an identical configuration. This is readily evident from an examination of a portion of the woven wire screen A inside of the dashed lined box B in FIG. 1. Specifically, upper knuckle C of weft wire 6 is offset vertically above upper knuckle D of adjacent weft wire 6 due to the fact that upper knuckle C passes over straight warp wire 2 and upper knuckle D passes over valley E in crimped warp wire 4. This variation in the orientation of the upper knuckles in the weft wires 6 will increase the tumbling action of screen A to improve the throughput of product during the process of classifying material. It should be noted that the variation in orientation of the upper knuckles of the weft wires 6 is achieved using weft wires 6 that are identical. It should be further noted that a variation in orientation of the upper knuckles of the weft wires 6 could be achieved by using a crimped wire for each of the straight warp wires 2 where the crimp depth is different than the crimp depth of warp wires 4.

Figure 3:
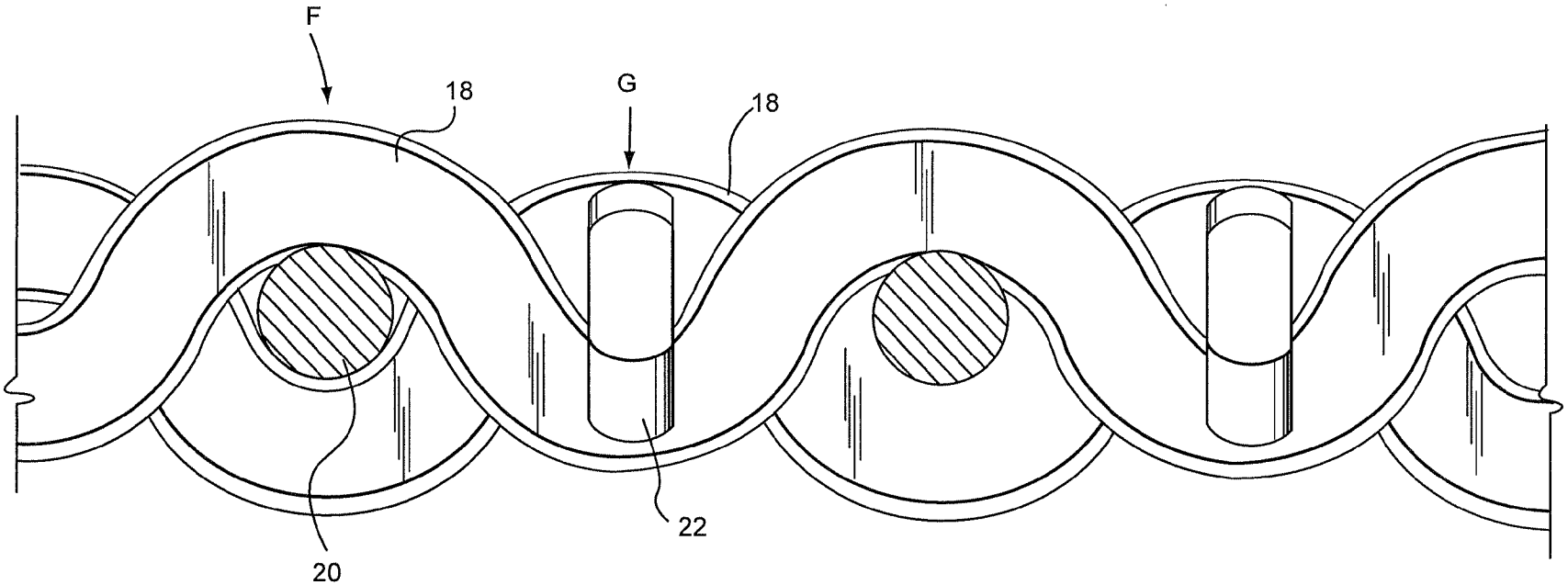
FIG. 3 is a cross-sectional view taken along the traverse axis (i.e., an axis extending parallel to the weft wires) of a variation of the woven wire screening depicted in FIG. 1 where the weft wires are crimped differently from the weft wires in FIG. 1.
Figure 4:
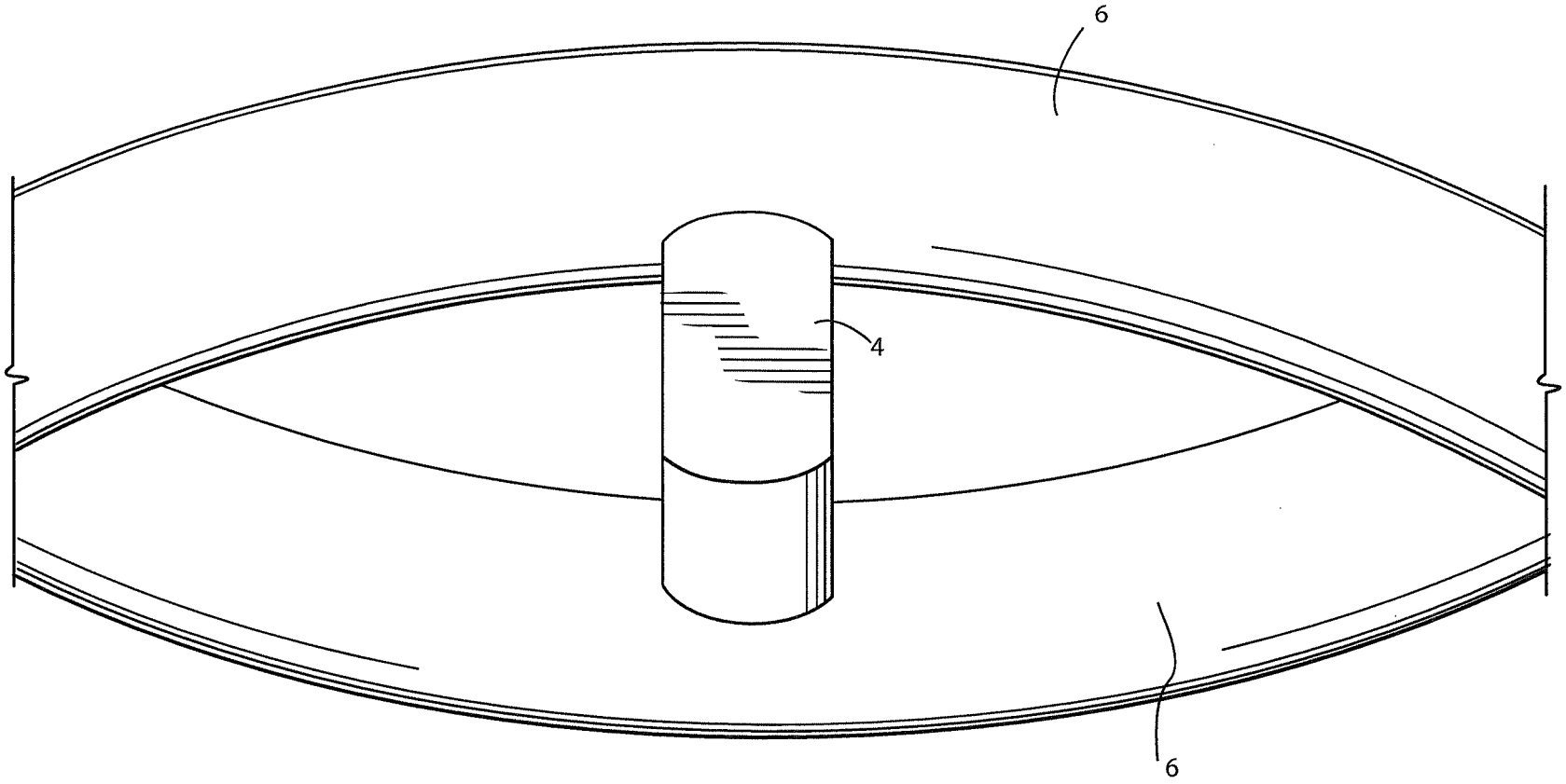
FIG. 4 is an enlarged view of a portion of the woven wire screening depicted in FIG. 1.

The variation in orientation of upper knuckles of the weft wires is readily apparent from FIG. 3 depicting a cross-sectional view taken along a transverse axis of a woven wire screen similar to screen A. The primary difference between the screen depicted in FIG. 3 from screen A is the crimping of the weft wires, i.e., weft wires 18 are crimped differently than weft wires 6. All of the weft wires 18 of the screen depicted in FIG. 3 are identical yet upper knuckle F of weft wire 18 is offset vertically above upper knuckle G of the adjacent weft wire 18 due to the fact that upper knuckle F passes over straight wire 20 and upper knuckle G passes over a valley in crimped wire 22.

By forming the warp wires 4 prior to interweaving with the weft wires 6 such that the crimp depth of the warp wires 4 is less than the crimp depth of the weft wires 6, upper knuckles 10 of the warp wires 4 will be offset vertically from upper knuckles 14 of weft wires 6 to further vary the orientation of upper knuckles in the screen A to further enhance tumbling action of product impacting the upper surface of the woven screen A. This knuckle height differential between the upper knuckles 14 of weft wires 6 and the upper knuckles 10 of the warp wires 4 created by the crimping process is altered when the weft wires and warp wires are interwoven due to the use of alternating straight warp wires 2 and crimped warp wires 4. For example, the height differential between the upper knuckle 14 of a weft wire 6 that passes over a straight wire 2 and an adjacent upper knuckle 10 of a warp wire 4 will be greater than the height differential between these knuckles created during crimping of the corresponding weft wire and warp wire.

Figure 7:
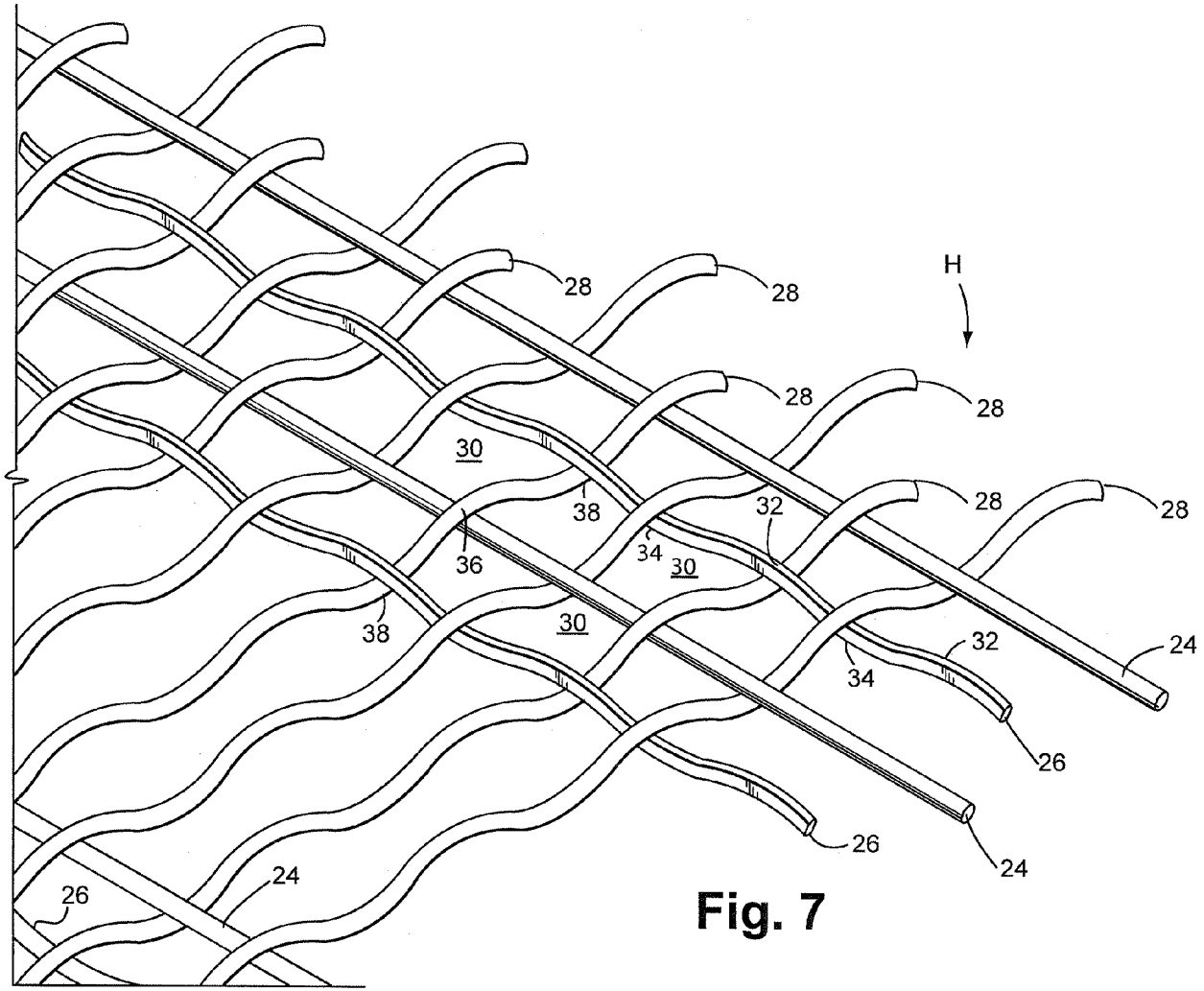
FIG. 7 is a perspective view of a portion of a woven wire screening formed in accordance with another preferred embodiment of the present invention.
Figure 8:
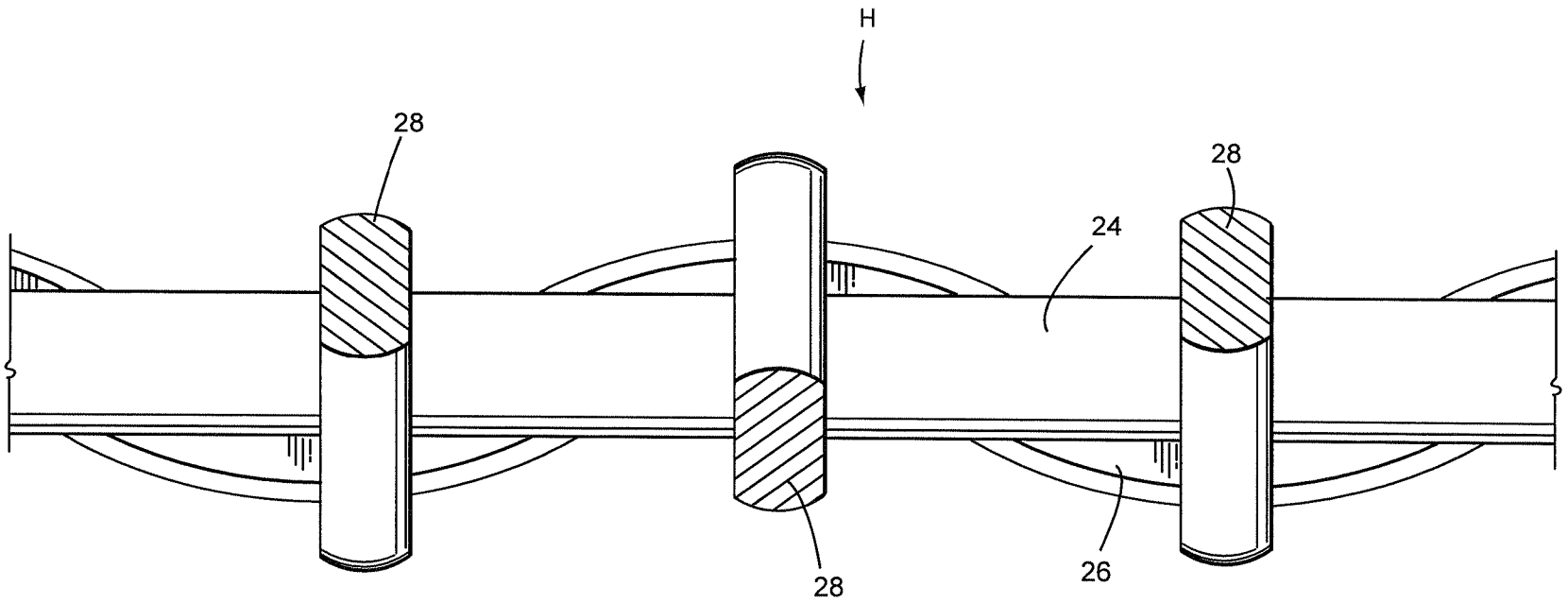
FIG. 8 is a cross-sectional view taken along the traverse axis (i.e., an axis extending parallel to the weft wires) of a variation of the woven wire screening depicted in FIG. 7.

FIGS. 7 and 8

Referring to FIGS. 7 and 8, a woven wire screening or screen H formed in accordance with another preferred embodiment of the present invention is illustrated in one of many possible configurations. Screen H includes a first set of weft wires 24 and a second set of weft wires 26. Screen H further includes a plurality of warp wires 28. It should be noted that some weft wires have been removed from the screen portion depicted in FIG. 7 for purposes of illustration only.

The first set of weft wires 24, the second set of weft wires 26 and the plurality of warp wires 28 are interwoven to form an integral wire cloth having a plurality of openings 30 through which appropriately sized product passes through during the process of classifying materials into various sizes or size ranges. Preferably, all of the openings 30 in woven wire screen H are of the same size and shape. Openings 30 are preferably rectangular or square. It should be noted that this embodiment is not limited to woven wire screens having openings of the same size and shape. For example, the screen can be formed as a long slot screen where the warp wires are maintained in spaced parallel relation by weft wires arranged in groups of three at spaced intervals along the length of the warp wires. The long slot screen has at least two different size openings.

The first set of weft wires 24 are straight wires, i.e., wires that are not crimped prior to interweaving the weft and warp wires to form the integral wire cloth. The weft wires 24 are shown as having a circular cross-section. However, weft wires 24 can be shaped in a similar manner as weft wires 26 to have two substantially flat sidewalls. Weft wires 26 are crimped prior to interweaving of the warp and weft wires to form upper knuckles 32 and lower knuckles 34 alternately spaced along the length of each of the weft wires 26.

Weft wires 26 are shown as being shaped wires, i.e., wires that have passed through shaping rollers to form two substantially flat sidewalls. However, weft wires 26 could have a circular cross-section similar to that of weft wires 24. In the embodiment illustrated in FIG. 7, the odd weft wires are straight wires and the even weft wires are crimped wires. However, the odd weft wires could be crimped and the even weft wires straight. Further, the arrangement of the straight weft wires and crimped weft wires can be varied as desired. For example, the screen H could be configured such that you have two or more straight weft wires on each side of one or more crimped weft wires. Alternatively, screen H could be configured such that you have two or more crimped weft wires on each side of one or more straight weft wires.

Each of the warp wires 28 are preferably crimped wires having upper knuckles 36 and lower knuckles 38. Warp wires 28 are shown as being shaped wires having two substantially flat sidewalls. However, warp wires 28 can have a circular cross-section similar to weft wires 24. It should be noted that regardless of the cross-sectional shape of the warp and weft wires each of the warp wires 28 and weft wires 24 and 26 can originate from the same size wire. The crimp depth of the weft wires 26 of screen H is less than the crimp depth of warp wires 28. However, it will be readily appreciated that the crimp depth of weft wires 26 can be greater than the crimp depth of warp wires 28. Screen H may be formed such that the ratio of the knuckle height differential between the upper knuckles of the weft wires 26 and the upper knuckles of warp wires 28 and a width of opening 30 ranges from 5% to 35% pursuant to the teachings of U.S. Pat. No. 7,815,053.

Woven wire screen H achieves a knuckle height differential between adjacent upper knuckles 36 of the warp wires 28 even though each of the warp wires 28 has an identical configuration by using alternating straight and crimped weft wires. This variation in the orientation of the upper knuckles 36 in the warp wires 28 will increase the tumbling action of screen A to improve the throughput of product during the process of classifying material. It should be further noted that a variation in orientation of the upper knuckles of the warp wires 28 could be achieved by using a crimped wire for each of the straight weft wires 24 where the crimp depth is different than the crimp depth of weft wires 24.

By forming the warp wires 28 such that the crimp depth of the warp wires 28 is greater than the crimp depth of the weft wires 26, upper knuckles 36 of the warp wires 28 will be offset vertically above upper knuckles 32 of weft wires 26 to further vary the orientation of upper knuckles in the screen H to further enhance tumbling action of product impacting the upper surface of the woven screen H. This knuckle height differential between the upper knuckles 36 of warp wires 28 and the upper knuckles 32 of the warp wires 26 created by the crimping process is altered when the weft wires and warp wires are interwoven due to the use of alternating straight weft wires 24 and crimped weft wires 26. For example, the height differential between the upper knuckle 36 of a warp wire 28 that passes over a straight wire 24 and an adjacent upper knuckle 32 of a weft wire 26 will be greater than the height differential between these knuckles created during crimping of the corresponding weft wire and warp wire.

FIGS. 9-11

Figure 9:
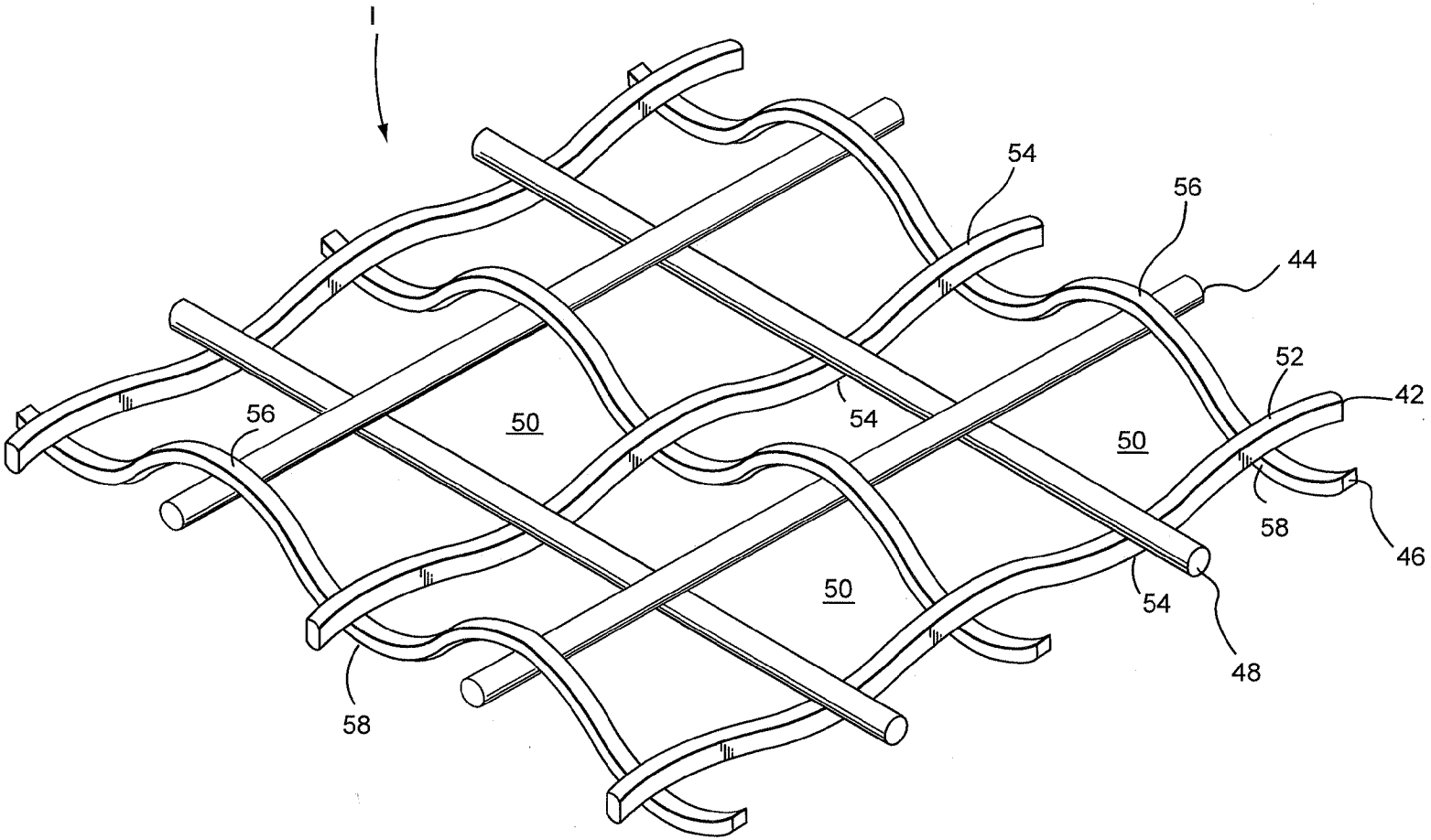
FIG. 9 is a perspective view of a portion of a woven wire screening formed in accordance with a further preferred embodiment of the present invention.
Figure 10:
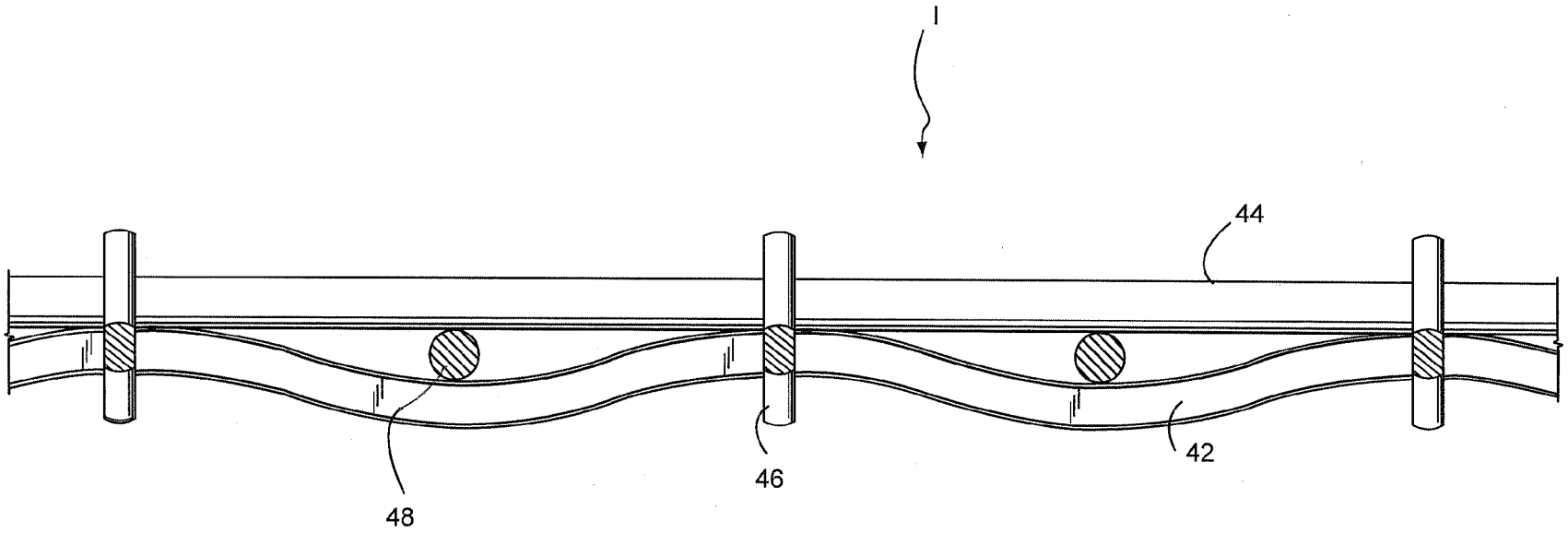
FIG. 10 is a cross-sectional view taken along the longitudinal axis (i.e., an axis extending parallel to the warp wires) of the preferred embodiment depicted in FIG. 9.
Figure 11:
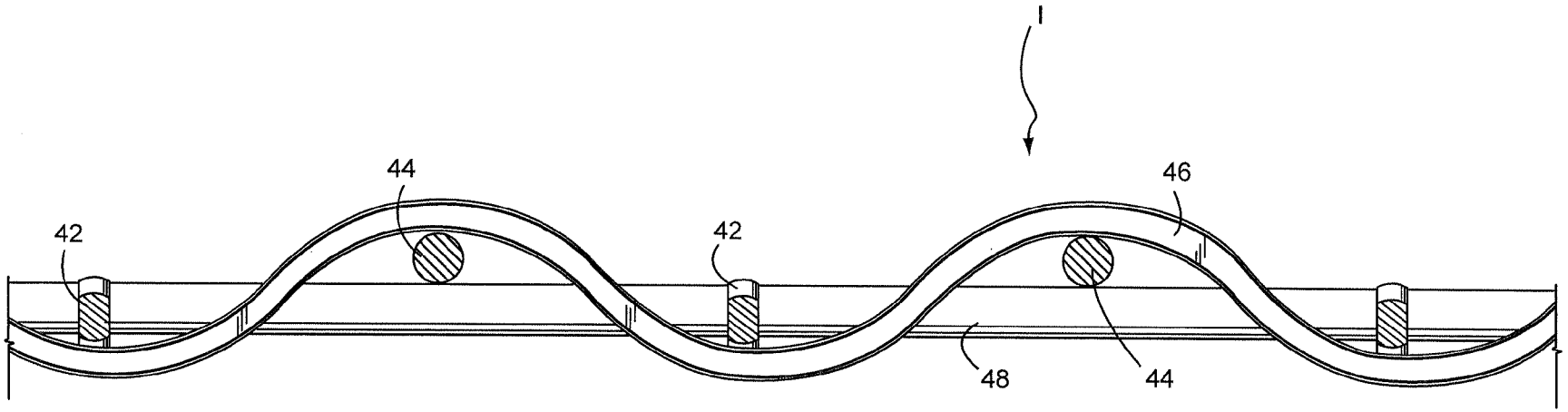
FIG. 11 is a cross-sectional view taken along the traverse axis (i.e., an axis extending parallel to the weft wires) of a variation of the woven wire screening depicted in FIG. 9.

Referring to FIGS. 9 to 11, a woven wire screening or screen I formed in accordance with a further preferred embodiment of the present invention is illustrated in one of many possible configurations. Screen I includes a first set of warp wires 42 and a second set of warp wires 44. Screen I further includes a first set of weft wires 46 and a second set of weft wires 48. Preferably, the weft wires 46 and 48 are uniformly spaced along the length of first and second sets of warp wires 42 and 44, respectively.

The first set of warp wires 42, the second set of warp wires 44, the first set of weft wires 46 and the second set of weft wires 48 are interwoven to form an integral wire cloth having a plurality of openings 50 through which appropriately sized product passes through during the process of classifying materials into various sizes or size ranges. In the most preferred embodiment, all of the openings 50 in woven wire screen I are of the same size and shape. Preferably, openings 50 are rectangular or square. It should be noted that the present invention is not limited to woven wire screens having openings of the same size and shape. For example, the screen can be formed as a long slot screen where the warp wires are maintained in spaced parallel relation by weft wires arranged in groups of three at spaced intervals along the length of the warp wires. The long slot screen has at least two different size openings.

The first set of warp wires 42 and the first set of weft wires 46 are shaped, crimped wires. The second set of warp wires 44 and weft wires 48 are straight wires, i.e., wires that are not crimped prior to interweaving the weft and warp wires to form the integral wire cloth. While wires 44 and weft wires 48 are shown as having a circular cross-section, these wires can be shaped similar to wires 42 and 46 to have two substantially flat sidewalls. Alternatively, all weft and warp wires could have a circular cross-section.

Warp wires 42 are crimped prior to interweaving of the warp and weft wires to form upper knuckles 52 and lower knuckles 54 alternately spaced along the length of each of the warp wires 42. Weft wires 46 are crimped prior to interweaving of the warp and weft wires to form upper knuckles 56 and lower knuckles 58 alternately spaced along the length of each of the warp wires 42.

In the embodiment illustrated in FIG. 9, the odd warp and weft wires are crimped wires and the even weft and warp wires are straight wires. However, the odd warp and weft wires could be straight and the even weft and warp wires crimped. Further, the arrangement of the straight wires and crimped wires can be varied as desired. For example, the screen I could be configured such that you have two or more straight warp wires on each side of one or more crimped warp wires and two or more straight weft wires on each side of one or more crimped weft wire. Alternatively, screen I could be configured such that you have two or more crimped warp wires on each side of one or more straight warp wires and two or more crimped weft wires on each side of one or more straight weft wire.

Preferably, the crimp depth of the weft wires 46 is greater than the crimp depth of warp wires 42. Screen I may be formed such that the ratio of the knuckle height differential between the upper knuckles of the weft wires 46 and the upper knuckles of warp wires 42 and a width of opening 50 ranges from 5% to 35% pursuant to the teachings of U.S. Pat. No. 7,815,053. It should be noted that the crimp depth of the weft wires 46 could be less than the crimp depth of the warp wires 42.

The use of alternating straight and crimped weft and warp wires creates a screen having an irregular upper screening, i.e., the height of the screening surface various across the width and length of the screening surface to increase the tumbling action of product impacting the irregular screening surface. To further accentuate the irregular nature of the screening surface, two or more different size warp wires 44 and weft wires 48 could be used in a repeating pattern, e.g., a first straight warp wire having a first height followed by a second straight warp wire having a height greater than the first straight warp wire and a first straight weft wire having a first height followed by a second straight weft wire having a height greater than the height of the first straight weft wire. It should be noted that screen I can be formed such that the height of the straight warp wires are different from the height of the straight weft wires.

FIGS. 12-14

Figure 12:
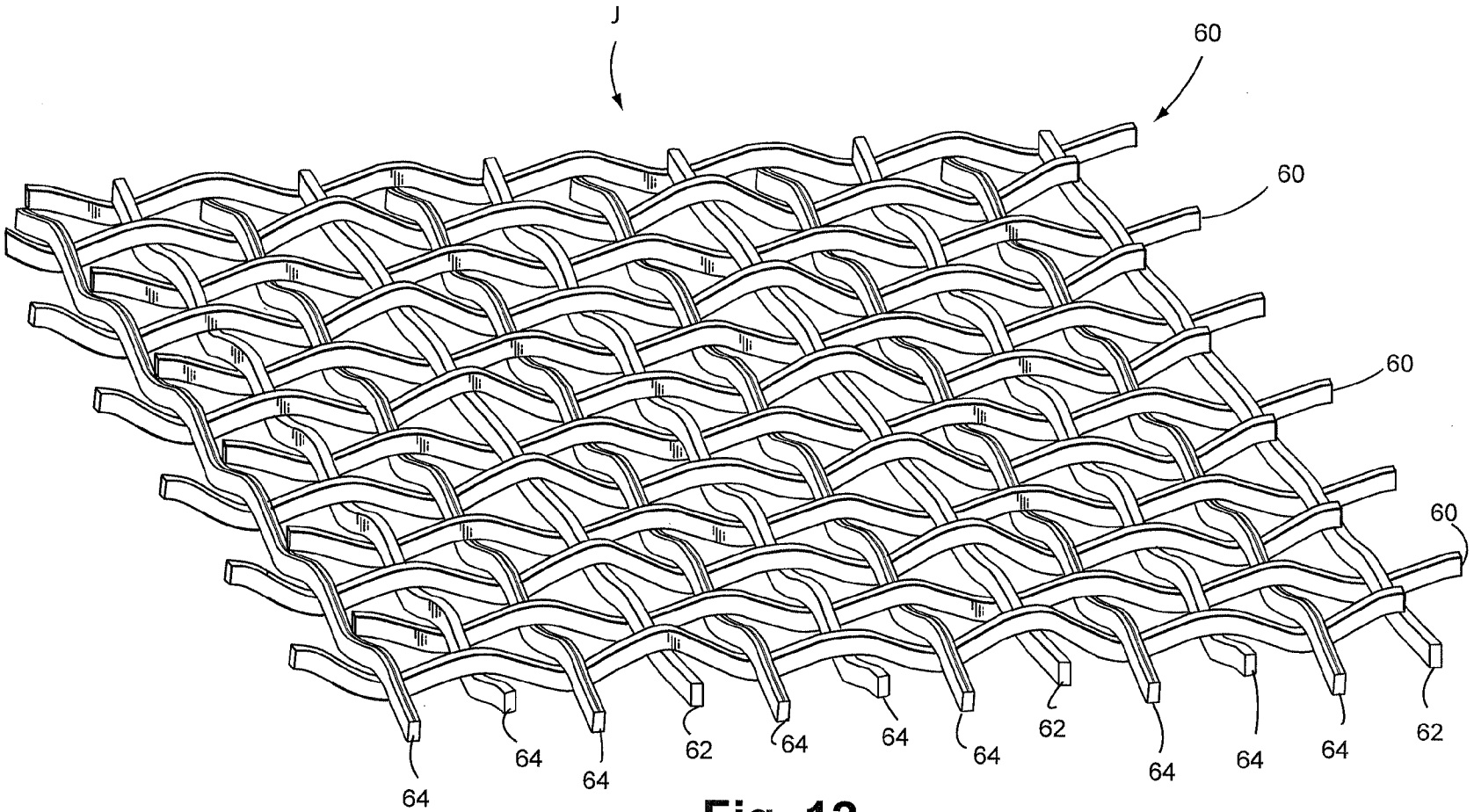
FIG. 12 is a perspective view of a portion of a woven wire screening formed in accordance with still a further preferred embodiment of the present invention.
Figure 13:
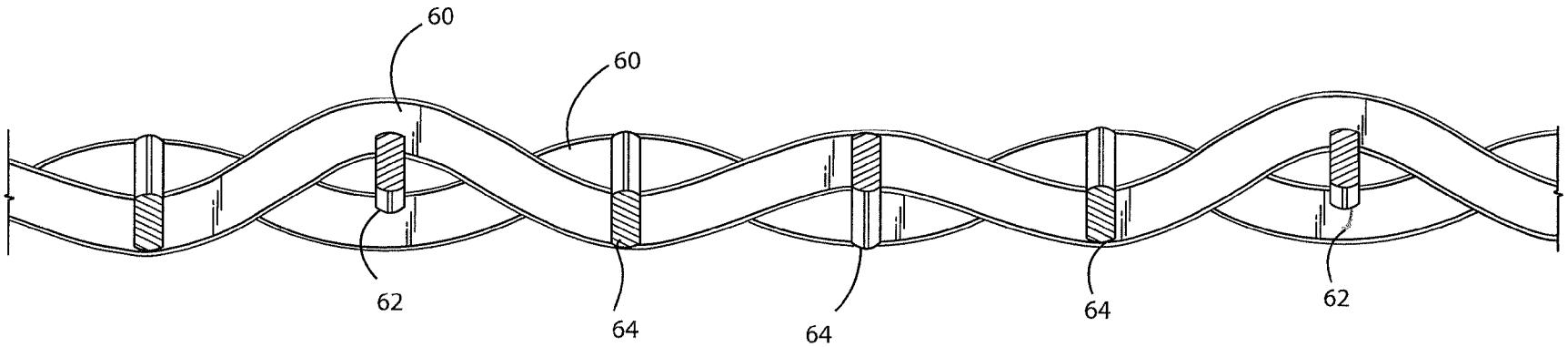
FIG. 13 is a cross-sectional view taken along the longitudinal axis (i.e., an axis extending parallel to the warp wires) of the preferred embodiment depicted in FIG. 12.
Figure 14:
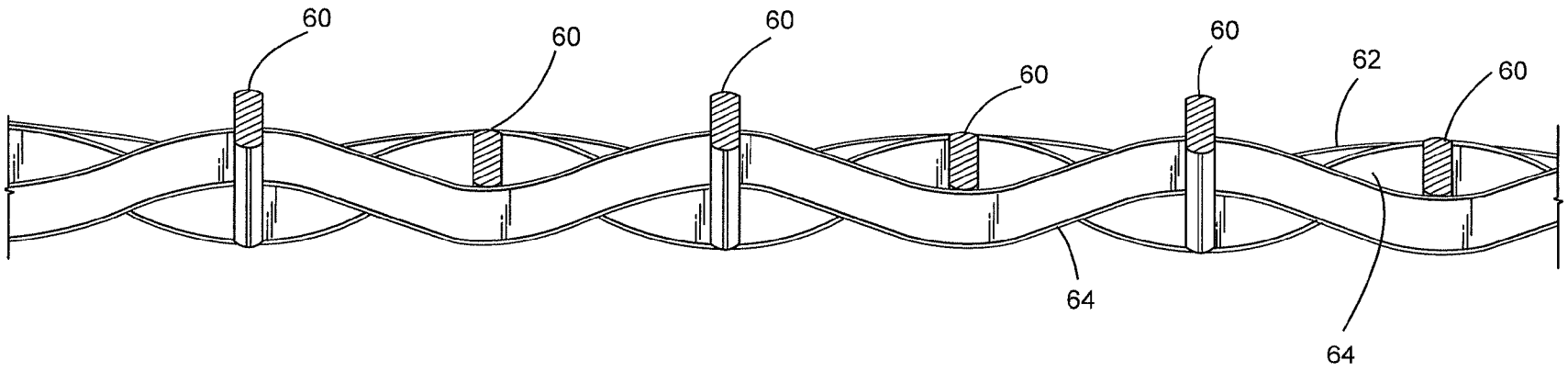
FIG. 14 is a cross-sectional view taken along the traverse axis (i.e., an axis extending parallel to the weft wires) of a variation of the woven wire screening depicted in FIG. 12.

Referring to FIGS. 12 to 14, a woven wire screening or screen J formed in accordance with a further preferred embodiment of the present invention is illustrated in one of many possible configurations. Screen J includes a plurality of warp wires 60, a first set of weft wires 62 and a second set of weft wires 64. Preferably, the weft wires 62 and 64 are uniformly spaced along the length of the warp wires 60, respectively. Preferably, each of the warp wires 60 are substantially identical. The first set of weft wires 62 are crimped shallower than the crimping of the second set of weft wires 64. The variation in crimp depth of weft wires creates a knuckle height variation between upper knuckles of warp wires passing over weft wires 62 and upper knuckles of warp wires passing over weft wires 64 (see FIG. 13) to create an irregular screening surface to enhance tumbling action of product impacting the screening surface of screen J. While all of the warp and weft wires are shown as being shaped wires having two substantially flat sidewalls, some or all of the wires of screen J can have a circular cross-section. Further, the pattern or weft wires 62 and wefts wires 64 can be varied from that shown in FIG. 12 illustrating one weft wire 62 followed by three weft wires 64.

FIGS. 15-18

Figure 15:
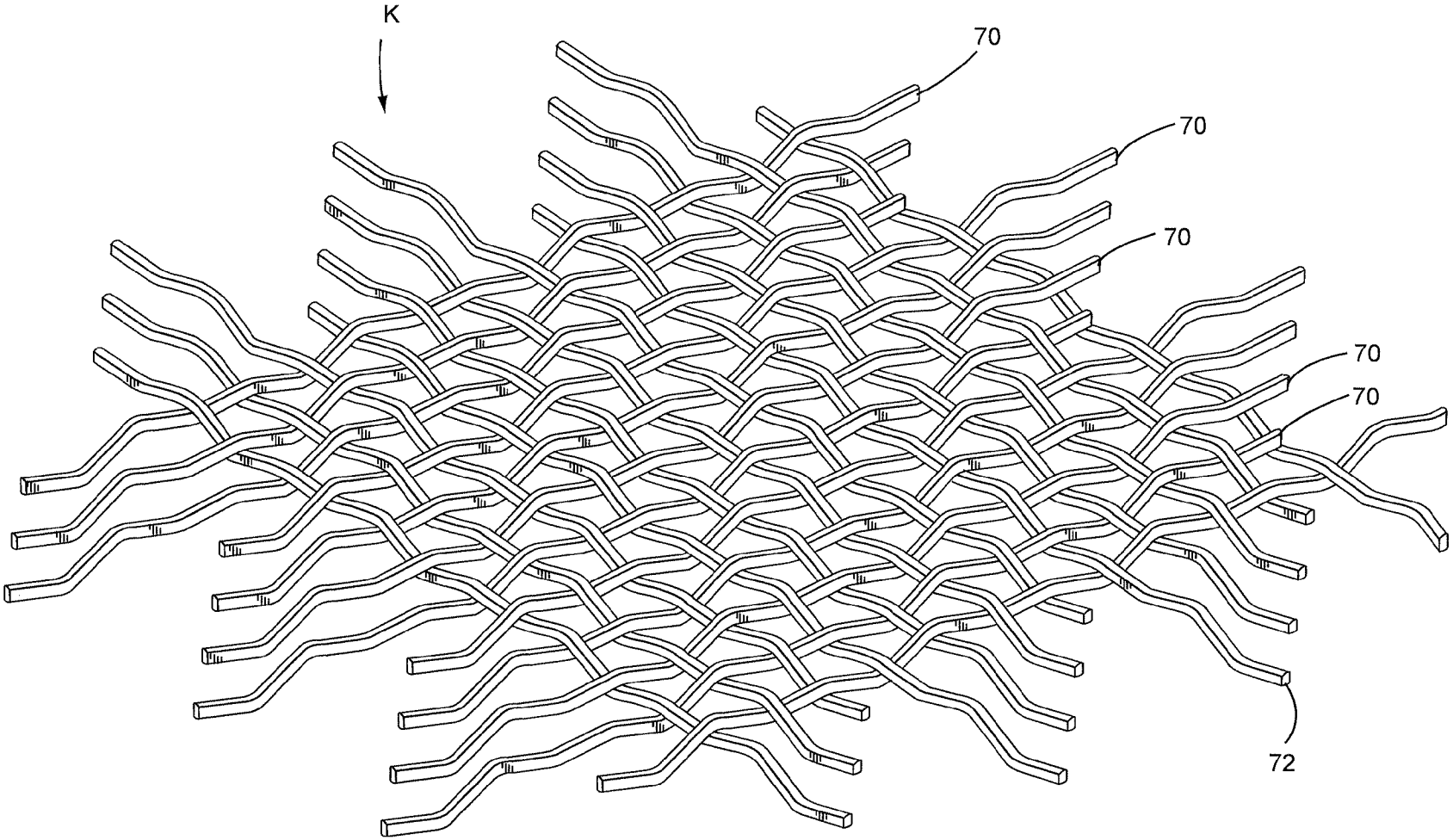
FIG. 15 is a perspective view of a portion of a woven wire screening formed in accordance with yet a further preferred embodiment of the present invention.
Figure 16:
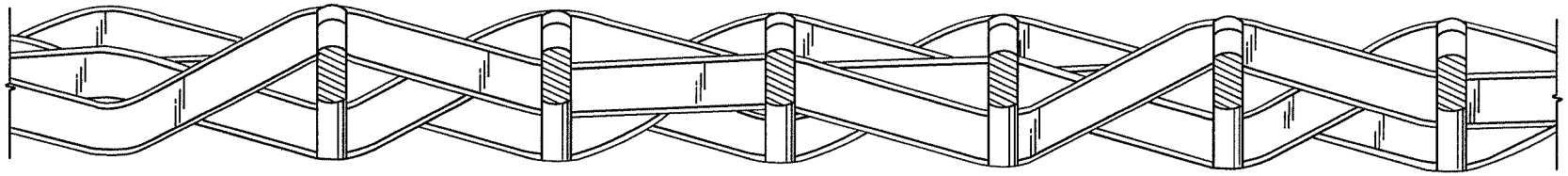
FIG. 16 is a cross-sectional view taken along the longitudinal axis (i.e., an axis extending parallel to the warp wires) of the preferred embodiment depicted in FIG. 15.
Figure 17:
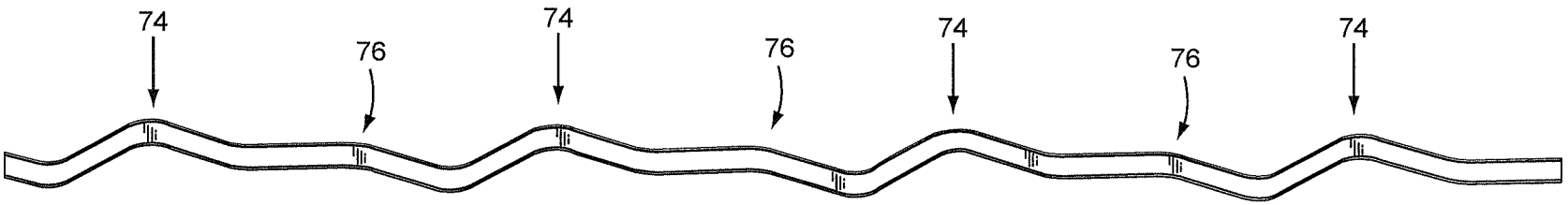
FIG. 17 is a front elevation view of a preferred form of wire of the woven wire screening depicted in FIG. 15.

Referring to FIGS. 15 to 17, a woven wire screening or screen K formed in accordance with a further preferred embodiment of the present invention is illustrated in one of many possible configurations. Screen K includes a plurality of warp wires 70 and a plurality of weft wires 72. Preferably, the weft wires 72 are uniformly spaced along the length of the warp wires 70, respectively. Preferably, each of the warp wires 70 and weft wires 72 are substantially identical and take the form depicted in FIG. 17. As readily seen in FIG. 17, each wire has a crimping such that at least one set of upper knuckles 74 are offset vertically from at least one other set of upper knuckles 76 of each wire of the woven wire screen K. By forming the each of the wires of screen K in this manner, an irregular screening surface is achieved from wires having an identical configuration. While all of the warp and weft wires are shown as being shaped wires having two substantially flat sidewalls, some or all of the wires of screen K can have a circular cross-section.

Figure 18:
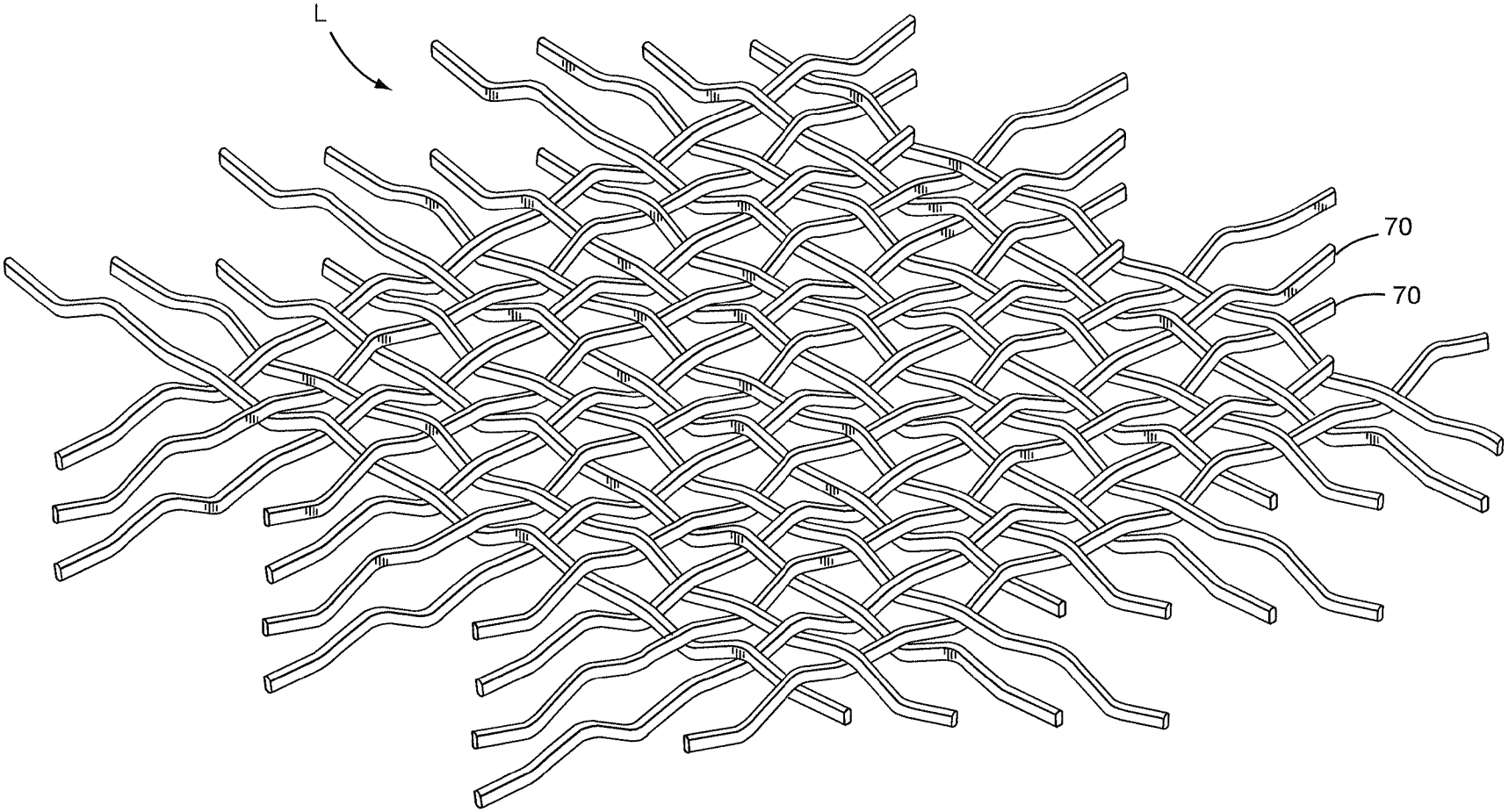
FIG. 18 is a perspective view of a portion of a woven wire screening formed in accordance with a further preferred embodiment of the present invention.

Referring to FIG. 18, the screen L is similar to the screen K depicted in FIG. 15. The only difference between screen L and screen K is that odd warp wires 70 of screen L have a first end disposed on the left side of the page of FIG. 18 and the same first end of the even warp wires 70 is disposed on the right side of the page. So the warp wires 70 of screen L have the same configuration but every other warp wire is oriented to extend oppositely to an adjacent warp wire.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A woven wire screening for use in classifying material flowing through said woven wire screening; said woven wire screening comprising:

(a) a plurality of weft wires;

(b) a plurality of warp wires, said plurality of warp wires including a plurality of first warp wires and at least one second warp wire, said plurality of warp wires and said plurality of weft wires being interwoven to form an integral wire cloth having a plurality of openings for permitting material to be classified to flow through said openings;

(c) each of said plurality of first warp wires being crimped to form upper and lower knuckles, said plurality of weft wires being crimped to form upper and lower knuckles, said plurality of weft wires having two substantially flat sidewalls, said plurality of weft wires having a first crimp depth and said plurality of first warp wires having a second crimp depth different from the first crimp depth such that said upper knuckles of said plurality of weft wires are offset vertically from said upper knuckles of said first warp wires creating a knuckle height differential between said upper knuckles of said plurality of weft wires and said upper knuckles of said first warp wires, said plurality of weft wires, said plurality of first warp wires and said at least one second warp wire being formed from wire having the same diameter; and (d) said at least one second warp wire is one of a straight wire and a crimped wire having a crimp depth different from said second crimp depth.

2. A woven wire screening as set forth in claim 1, wherein:

(a) said plurality of warp wires include a plurality of second warp wires, said woven wire cloth is formed such that the first warp wires and the second warp wires alternate over the length of the plurality of weft wires such that each opening in the integral wire cloth is partially formed by a first warp wire and a second warp wire.

3. A woven wire screening as set forth in claim 2, wherein:

(a) a ratio of a first knuckle height differential and a width of at least one of said plurality of openings ranges from 5% to 35%, the first knuckle height differential is a height differential between an upper knuckle of one warp wire and an adjacent upper knuckle of one weft wire.

4. A woven wire screening as set forth in claim 2, wherein:
(a) the knuckle height differential of the integral woven wire cloth is greater than the knuckle height differential between said upper knuckles of said weft wires and said upper knuckles of said first warp wires created by crimping the plurality of first warp wires and the plurality of weft wires.

5. A woven wire screening as set forth in claim 2, wherein:
(a) each of said plurality of first warp wires have two substantially flat sidewalls and each of said plurality of second warp wires have two substantially flat sidewalls.

6. A woven wire screening as set forth in claim 5, wherein:
(a) each of said plurality of second warp wires are formed from wire having the same diameter.

7. A woven wire screening as set forth in claim 1, wherein:
(a) the integral wire cloth includes weft wires uniformly spaced along substantially the entire length of said plurality of warp wires.

8. A woven wire screening as set forth in claim 1, wherein:
(a) all openings in the integral wire cloth have a substantially square configuration.

9. A woven wire screening for use in classifying material flowing through said woven wire screening; said woven wire screening comprising:
(a) a plurality of warp wires;
(b) a plurality of weft wires, said plurality of warp wires and said plurality of weft wires being interwoven to form an integral wire cloth having a plurality of openings for permitting material to be classified to flow through said openings;
(c) said plurality of warp wires including a plurality of first warp wires being crimped to form upper and lower knuckles, said plurality of weft wires including a plurality of first weft wires being crimped to form upper and lower knuckles, said plurality of first weft wires having a first crimp depth and said plurality of first warp wires having a second crimp depth different from the first crimp depth such that said upper knuckles of said plurality of first weft wires are offset vertically from said upper knuckles of said plurality of first warp wires creating a knuckle height differential between said upper knuckles of said plurality of first weft wires and said upper knuckles of said plurality of first warp wires, said plurality of first weft wires having two substantially flat sidewalls; and,
(d) said plurality of weft wires includes at least one of a straight weft wire, said plurality of crimped warp wires, said plurality of crimped weft wires and said at least one straight weft wire are formed from wire having the same diameter.

10. An apparatus as set forth in claim 9, wherein:
(a) said plurality of weft wires include a plurality of straight weft wires, the plurality of crimped weft wires and the plurality of straight weft wires alternate along the length of the plurality of warp wires such that each opening in the integral wire cloth is partially formed by a straight weft wire and a crimped weft wire.

11. A woven wire screening as set forth in claim 9, wherein:
(a) a ratio of a first knuckle height differential and a width of at least one of said plurality of openings ranges from 5% to 35%, the first knuckle height differential is a height differential between an upper knuckle of one of said plurality of first warp wires and an adjacent upper knuckle of one of said plurality of first weft wires.

12. A woven wire screening as set forth in claim 9, wherein:
(a) the knuckle height differential of the integral wire cloth is different than the knuckle height differential between said upper knuckles of said crimped weft wires and said upper knuckles of said crimped warp wires created by crimping the plurality of first warp wires and the plurality of weft wires.

13. A woven wire screening as set forth in claim 9, wherein:
(a) said plurality of weft wires includes at least one straight weft wire, each of said plurality of crimped warp wires have two substantially flat sidewalls and said at least one straight weft wire has two substantially flat sidewalls.

14. A woven wire screening as set forth in claim 9, wherein:
(a) all of the openings of the integral wire cloth have substantially the same size.

15. A woven wire screening as set forth in claim 14, wherein:
(a) all of the openings of the integral wire cloth have a substantially square configuration.

16. A method of forming an integral wire cloth used in classifying material flowing through the integral wire cloth; said method including the steps of:
(a) providing a plurality of crimped warp wires having upper and lower knuckles;
(b) providing a plurality of crimped weft wires having upper and lower knuckles, the plurality of crimped weft wires are crimped differently than the plurality of crimped warp wires creating a first knuckle height differential between the upper knuckles of the crimped weft wires and the upper knuckles of the crimped warp wires;
(c) providing at least one additional wire extending parallel to one of: (i) said plurality of crimped weft wires and (ii) said plurality of crimped warp wires, the at least one additional wire having a crimp depth different from a crimp depth of at least one other crimped wire that the at least one additional wire extends parallel to;
(d) interweaving the plurality of crimped warp wires, the plurality of crimped weft wires and the at least one additional wire such that the at least one additional wire changes the first knuckle height differential between an upper knuckle of at least one crimped warp wire and an upper knuckle of at least one crimped weft wire; and
(e) forming an integral wire cloth such that substantially all openings in the integral wire cloth have substantially the same size.

17. A method as recited in claim 16, wherein:
(a) the at least one additional wire is a weft wire.

18. A method as recited in claim 16, wherein:
(a) the at least one additional wire is a warp wire.

19. A method as recited in claim 16, further including the steps of:
(a) forming each of the plurality of crimped warp wires to have a height greater than its width;
(b) forming each of the plurality of crimped weft wires to have a height greater than its width; and,
(c) forming the at least one additional wire to have a height greater than its width.

20. A woven wire screening for use in classifying material flowing through said woven wire screening; said woven wire screening comprising:

(a) a plurality of crimped weft wires;

(b) a plurality of crimped warp wires, said plurality of crimped warp wires and said plurality of crimped weft wires being interwoven to form an integral wire cloth having a plurality of openings for permitting material to be classified to flow through said openings;

and, (c) a first crimped wire, said first crimped wire being either a warp wire or a weft wire, said first crimped wire having a first set of knuckles, said first set of knuckles being a plurality of upper knuckles, at least one of said plurality of upper knuckles of said first crimped wire being offset vertically from at least one other of said plurality of upper knuckles of said first crimped wire.

21. A woven wire screening as set forth in claim 20, further including:

(a) a second crimped wire, said second crimped wire extending perpendicular to said first crimped wire, said second crimped wire having a plurality of upper knuckles, at least one of said plurality of upper knuckles of said crimped second wire being offset vertically from at least one other of said plurality of upper knuckles of said second crimped wire.

22. A woven wire screening for use in classifying material flowing through said woven wire screening; said woven wire screening comprising:

(a) a first set of crimped wires, each crimped wire in said first set of crimped wires extending parallel to all other crimped wires in said first set of crimped wires;

(b) a second set of crimped wires extending perpendicular to said first set of crimp wires, said first set of crimped wires and said second set of crimped wires being interwoven to form an integral wire cloth having a plurality of openings for permitting material to be classified to flow through said openings, the integral wire cloth having a plurality of upper knuckles formed by the second set of crimped wires; and (c) said first set of crimped wires including a first crimped wire having a first crimp depth and a second crimped wire having a second crimp depth different from said first crimp depth.

23. A woven wire screening for use in classifying material flowing through said woven wire screening; said woven wire screening comprising:

(a) a plurality of crimped weft wires, each of said plurality of crimped weft wires having two substantially flat sidewalls, a first cross-sectional height and upper and lower knuckles;

(b) a plurality of crimped warp wires, each of said plurality of crimped warp wires having two substantially flat sidewalls, a second cross-sectional height and upper and lower knuckles, the second cross-sectional height being equal to the first cross-sectional height; and, (c) a plurality of straight warp wires having a third cross-sectional height, the third cross-sectional height being less than the first cross-sectional height, said plurality of crimped warp wires, said plurality of crimped weft wires and said plurality of straight warp wires being interwoven to form an integral wire cloth having a plurality of openings for permitting material to be classified to flow through said plurality openings, each of the plurality of openings having substantially the same size and shape.

24. The woven wire screen as set forth in claim 23, wherein:

(a) each of said plurality of straight warp wires has a circular cross-section.

* * * * *